US009655227B2

(12) United States Patent
Wang et al.

(10) Patent No.: US 9,655,227 B2
(45) Date of Patent: May 16, 2017

(54) SLOT-COUPLED CW STANDING WAVE ACCELERATING CAVITY

(71) Applicant: JEFFERSON SCIENCE ASSOCIATES, LLC, Newport News, VA (US)

(72) Inventors: Shaoheng Wang, Yorktown, VA (US); Robert Rimmer, Yorktown, VA (US); Haipeng Wang, Glen Allen, VA (US)

(73) Assignee: JEFFERSON SCIENCE ASSOCIATES, LLC, Newport News, VA (US)

( * ) Notice: Subject to any disclaimer, the term of this patent is extended or adjusted under 35 U.S.C. 154(b) by 0 days.

(21) Appl. No.: 14/731,887

(22) Filed: Jun. 5, 2015

(65) Prior Publication Data

US 2015/0366046 A1 Dec. 17, 2015

Related U.S. Application Data

(60) Provisional application No. 62/011,920, filed on Jun. 13, 2014.

(51) Int. Cl.

| | |
|---|---|
| ***H05H 7/22*** | (2006.01) |
| ***H05H 9/04*** | (2006.01) |
| ***H05H 7/18*** | (2006.01) |

(52) U.S. Cl.

CPC ..... *H05H 9/044* (2013.01); *H05H 7/18* (2013.01); *H05H 7/22* (2013.01); *H05H 2007/225* (2013.01)

(58) Field of Classification Search

None

See application file for complete search history.

(56) References Cited

U.S. PATENT DOCUMENTS

| | | | | |
|---|---|---|---|---|
| 4,118,652 | A | 10/1978 | Vaguine | |
| 5,744,919 | A | 4/1998 | Mishin et al. | |
| 6,316,876 | B1 | 11/2001 | Tanabe | |
| 6,366,021 | B1 * | 4/2002 | Meddaugh | H05H 9/04 315/5.41 |
| 6,657,391 | B2 * | 12/2003 | Ding | H05H 7/18 315/5.41 |
| 7,208,890 | B2 * | 4/2007 | Zavadtsev | H05H 7/00 315/5.41 |
| 7,239,095 | B2 * | 7/2007 | Ho | H05H 9/04 315/5.41 |
| 7,262,566 | B2 * | 8/2007 | Pirozhenko | H05H 9/04 250/396 R |

(Continued)

*Primary Examiner* — Douglas W Owens
*Assistant Examiner* — Srinivas Sathiraju

(57) ABSTRACT

A slot-coupled CW standing wave multi-cell accelerating cavity. To achieve high efficiency graded beta acceleration, each cell in the multi-cell cavity may include different cell lengths. Alternatively, to achieve high efficiency with acceleration for particles with beta equal to 1, each cell in the multi-cell cavity may include the same cell design. Coupling between the cells is achieved with a plurality of axially aligned kidney-shaped slots on the wall between cells. The slot-coupling method makes the design very compact. The shape of the cell, including the slots and the cone, are optimized to maximize the power efficiency and minimize the peak power density on the surface. The slots are non-resonant, thereby enabling shorter slots and less power loss.

15 Claims, 8 Drawing Sheets

(56) References Cited

U.S. PATENT DOCUMENTS 7,423,381 B2 * 9/2008 Hanna ..... H05H 7/18 315/5.41
7,619,363 B2 11/2009 Whittum et al.
7,898,193 B2 * 3/2011 Miller ..... H05H 7/22 315/5.41
8,076,853 B1 * 12/2011 Caryotakis ..... H01J 25/10 315/5
8,169,166 B2 * 5/2012 Alimov ..... H05H 9/04 315/501
8,487,556 B2 * 7/2013 Yu ..... H05H 7/22 315/505
8,629,633 B2 * 1/2014 Heid ..... H05H 5/06 315/500
8,716,958 B2 * 5/2014 Sierra ..... H05H 9/04 315/500
8,723,451 B2 * 5/2014 Heid ..... H05H 5/02 315/3.6
8,754,596 B2 * 6/2014 Heid ..... H05H 5/06 315/500
8,766,217 B2 * 7/2014 Balakin ..... G21K 1/087 250/492.3
8,878,464 B2 * 11/2014 Clayton ..... H05H 15/00 250/395
8,975,816 B2 * 3/2015 Scheitrum ..... H01J 23/38 315/5.16
9,258,876 B2 * 2/2016 Cheung ..... H05H 7/02
9,326,366 B2 * 4/2016 Krasnykh ..... H05G 2/00
2004/0130276 A1 * 7/2004 Sayyarrodsari ..... G05B 13/042 315/501
2004/0254419 A1 * 12/2004 Wang ..... A61K 45/06 600/8
2005/0025797 A1 * 2/2005 Wang ..... A61L 31/16 424/422
2005/0134203 A1 * 6/2005 Salop ..... H05H 9/04 315/500

* cited by examiner

SLOT-COUPLED CW STANDING WAVE ACCELERATING CAVITY

CROSS-REFERENCE TO RELATED APPLICATIONS

This application claims the priority of Provisional U.S. Patent Application Ser. No. 62/011,920 filed Jun. 13, 2014.

GOVERNMENT LICENSE RIGHTS

This invention was made with government support under Management and Operating Contract No. DE-ACO5-060R23177 awarded by the Department of Energy. The United States Government has certain rights in the invention.

FIELD OF THE INVENTION

The present invention relates to particle accelerator structures and more particularly to a continuous wave (CW) multi-cell accelerating cavity.

BACKGROUND OF THE INVENTION

The side-coupling arrangement used in conventional accelerator cavities results in a large and complex assembly. Injectors using cavities of this type combined with thermionic cathodes typically exhibit an electron capture efficiency of less than 40%.

In order to reduce the performance limitations of side-coupled cavities, resonant coupling slots have been proposed in multi-cell accelerator structures. However, resonant slots require long slot openings and lead to high power losses and reduced efficiency.

This is important for industrial or medical applications requiring high average power beams. Unlike pulsed accelerators, where the thermal issues are less important, this invention is aimed at CW and high duty factor applications with high average beam power. The inclusion of the internal cooling is important in this regard and yields an additional advantage Accordingly, it would be desirable to provide a more compact and simpler accelerator arrangement and method for increasing the electron capture efficiency. Improving the power efficiency of the accelerating structure and the electron capture efficiency leads to a more compact and cost effective device and reduces the amount of input power required to drive the accelerator. This is particularly important for Continuous wave (CW) and high duty factor accelerators where the input power and cooling requirements are significant.

OBJECT OF THE INVENTION

It is therefore an object of the present invention to provide a more compact and simpler accelerator arrangement for a particle accelerator.

A further object of the invention is to provide a method for increasing the electron capture efficiency a particle accelerator.

Another object of the invention is to provide an accelerator arrangement that reduces the amount of input power required to drive the accelerator for a given output energy.

A further object is to provide an accelerator arrangement for Continuous Wave (CW) and high duty-factor accelerators that significantly reduces the input power and cooling requirements.

A further object of the invention is to provide cavities with internal slots that are symmetrical with respect to the cavity center axis and which do not introduce any transverse kicks to the accelerating beam and allow higher current operation.

BRIEF SUMMARY OF THE INVENTION

The present invention is a compact, efficient CW standing wave multi-cell accelerating cavity. To achieve high electron capture efficiency a graded beta accelerating structure is used in which each cell in the multi-cell cavity may have different cell lengths. Alternatively, to achieve high efficiency of acceleration for particles with beta equal to 1 (i.e. already traveling close to the speed of light), each cell in the multi-cell cavity may have the same optimized cell design. The coupling between cells is realized with a plurality of kidney-shaped slots on the wall between cells. The slot-coupling method makes the design very compact. The shape of the cell, including the slots and the cone, are optimized to maximize the power efficiency and minimize the peak power density on the surface. The slots are non-resonant, thereby enabling shorter slot lengths and less power loss.

DETAILED DESCRIPTION

The present invention is a compact, efficient CW standing wave accelerating cavity. This is a multi-cell cavity that can be used for graded beta acceleration with different cell designs, or for beta equal to 1 acceleration with the same cell design for each single cell. The coupling between cells is realized with a plurality of kidney-shaped slots on the wall between cells. The slot-coupling method makes the design very compact. The shape of the cell, including the slots and the cone, are optimized to maximize the power efficiency and minimize the peak power density on the surface.

Figure 1:
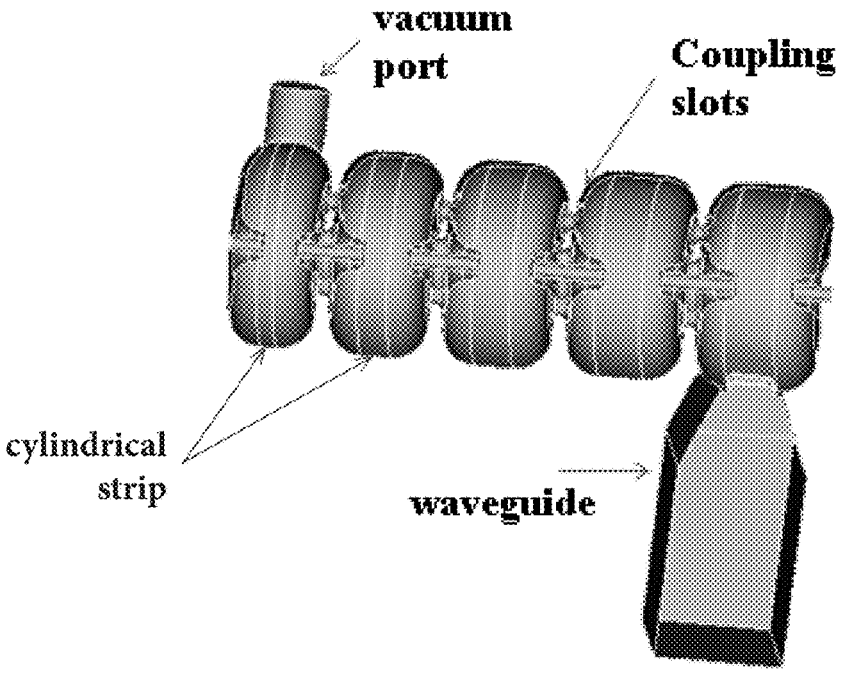
FIG. 1 is an isometric view of a 5-cell cavity for graded beta acceleration.
Figure 2:
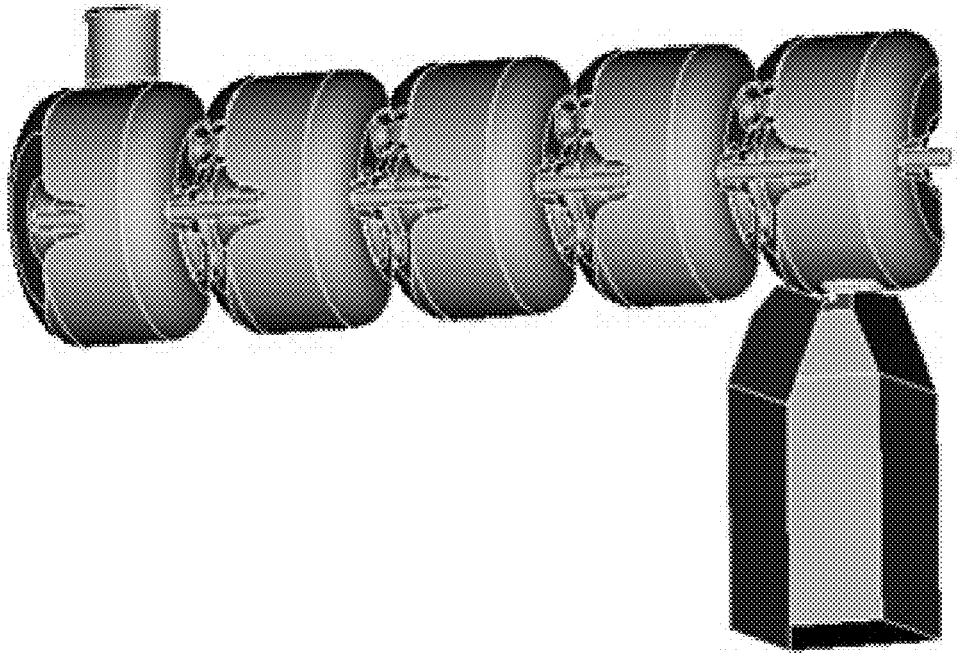
FIG. 2 is an isometric view of a 5-cell cavity for high beta acceleration.

Referring to FIG. 1, there is shown the preferred embodiment of a cavity design for graded beta acceleration. The preferred embodiment includes three of the slots. With a 7 kW power supply, 3 MV/m electric fields are produced, and electrons can be accelerated from beta=0.6 to 0.9. After that, electrons may be accelerated with a high beta cavity as shown FIG. 2 for further acceleration. The outer radius of each cell in both the graded beta cavities and the high beta cavities are the same. In order to lower the cost, the dimensions and geometry for parts of radius larger than the cones, including slots, are all the same in every cell.

Figure 3:
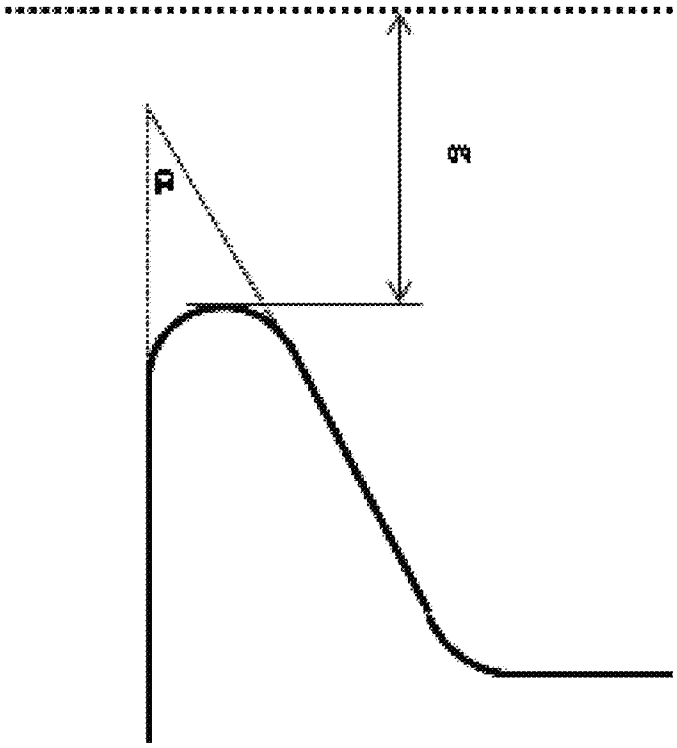
FIG. 3 is a plot depicting the relationship between gap spacing (g) and cone angle ($\alpha$) in a graded beta cavity.
Figure 4:
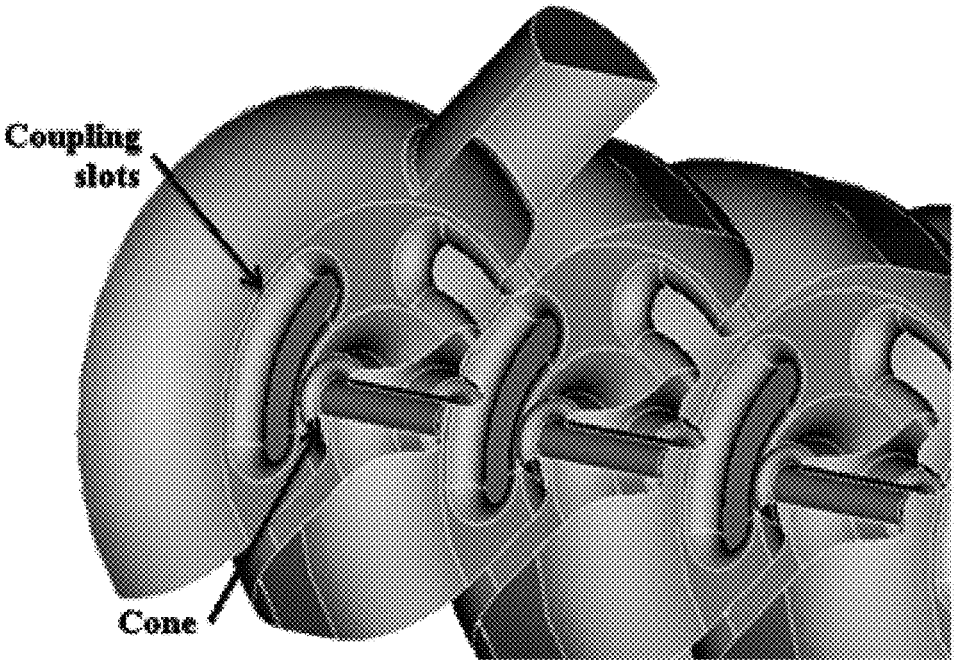
FIG. 4 is an isometric view of the details of a coupling slot in a slot-coupled accelerator cavity according to the present invention.

With reference to FIG. 3, in a graded beta cavity, the gap spacing g and cell length are varied to accommodate varying beta, while the cone angle $\alpha$ is same for all cells for easier manufacturing and lowering the cost. At the equator of each cell is a cylindrical strip, with reference to FIG. 1. The width of the strip is changed for different cells to vary the cell length. Accordingly, the extension of the cone is varied to obtain the optimized gap g in each cell. Details of the coupling slot are shown in FIG. 4. Each slot extends an angle of 60 degrees in azimuth with respect to the center symmetric axis.

Figure 5A:
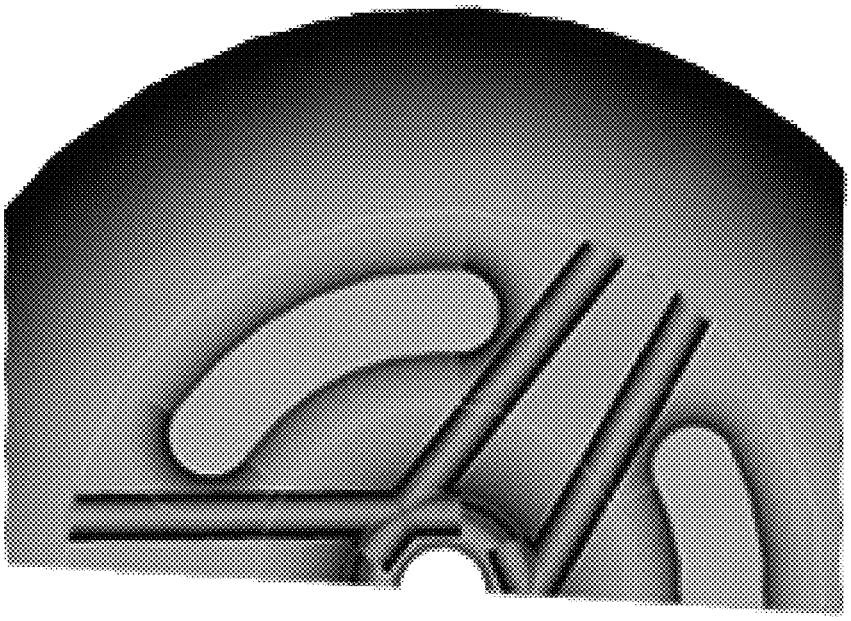
FIG. 5*a* is a view of the x-shaped cooling channels in the cell-to-cell wall of the slot-coupled accelerator cavity.
Figure 6A:
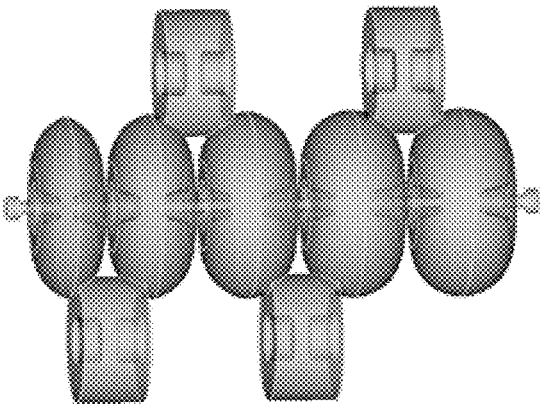
Fig. 6A (PRIOR ART)
FIG. 6*a* is a side view of a conventional side-coupling accelerator cavity such as used at the Jefferson National Accelerator Facility, Newport News, Va.
Figure 6B:
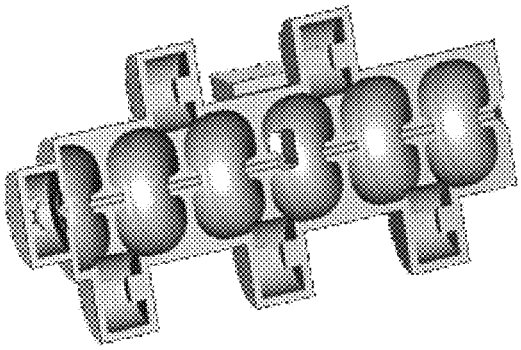
Fig. 6B (PRIOR ART)
FIG. 6*b* is a sectional view of a conventional side-coupling accelerator such as used in the Varian 600C accelerator, available from Varian Medical Systems, Inc., Palo Alto, Calif.
Figure 7A:
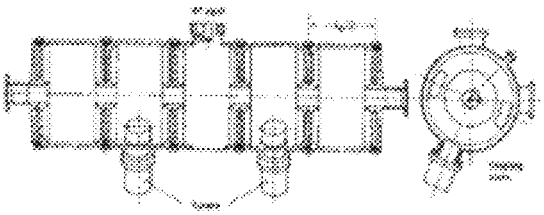
Fig. 7A (PRIOR ART)
FIG. 7*a* is a sectional view of a two-slot coupling for pill-box shaped cells such as used at the Large Electron-Positron Collider (LEP) at CERN in Geneva, Switzerland.
Figure 7B:
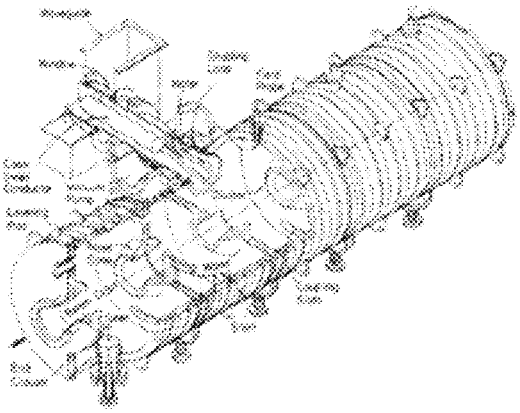
Fig. 7B (PRIOR ART)
FIG. 7*b* is an isometric view of a two-slot coupling for pill-box shaped cells such as used in PEP at SLAC National Accelerator Laboratory at Stanford University, Palo Alto, Calif.

For operation in CW mode, the cooling is important. As shown in the left portion of FIG. 5*a*, one or more X-shaped cooling channels are added in each cell-to-cell wall. The cooling channels go around the cone, effectively reducing the temperature. With this cooling design, on-axis electric field gradient has achieved 3 MV/m (without transit time factor) with peak temperature increment on the cone from 25° C. to 60° C. when the cavity wall loss power of 7 kW is to be removed.

Figure 8:
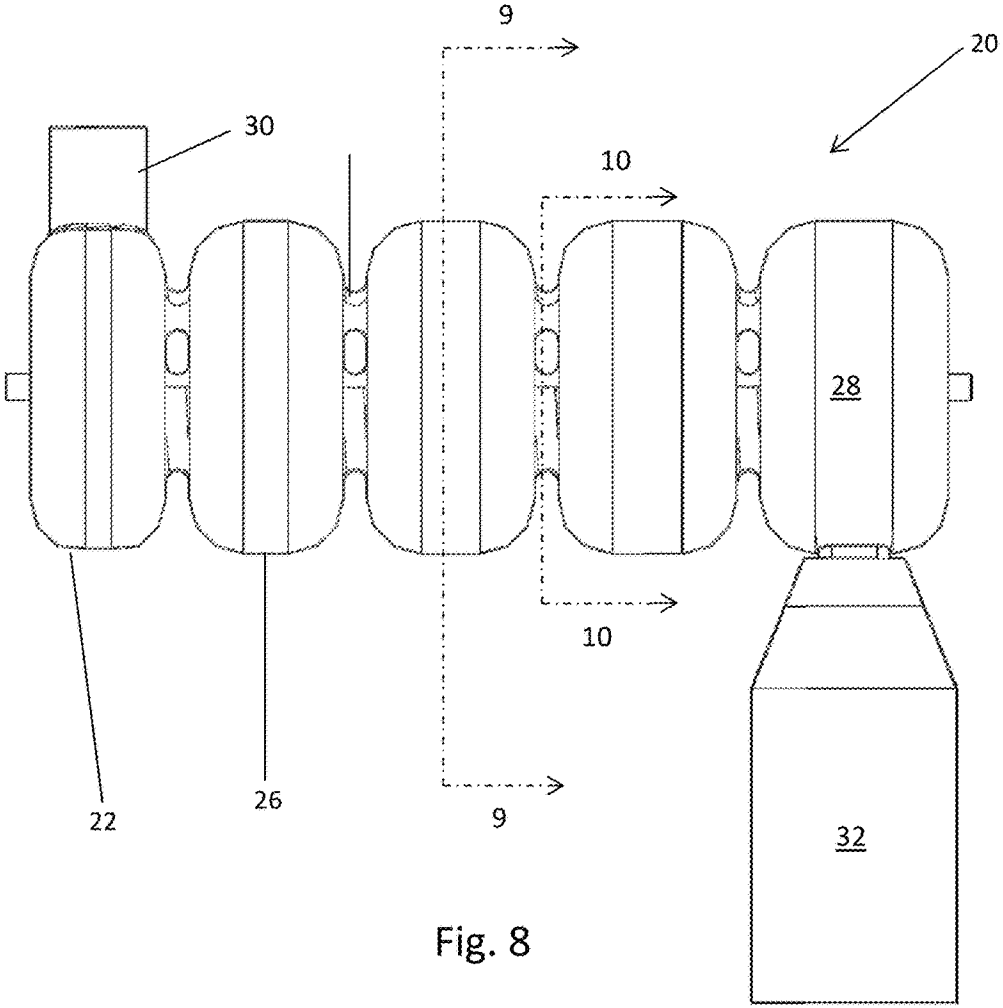
FIG. 8 is a side view of the preferred embodiment of the slot-coupled CW standing wave accelerating cavity.

With reference to FIG. 8, a slot-coupled CW standing wave accelerating cavity 20 according to the invention includes a plurality of cells 22 and a plurality of coupling structures 24 extending between the cells. Each cell 22 includes an equator 26 and a cylindrical strip 28. The accelerating cavity 20 further includes a vacuum port 30 and a waveguide 32.

Figure 10:
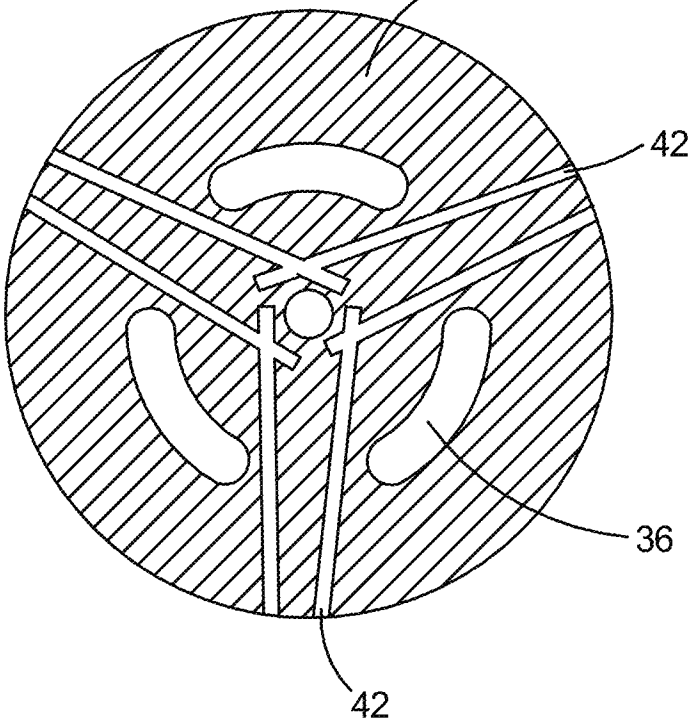
FIG. 10 is a sectional view taken along line 10-10 of FIG. 8.
Figure 9:
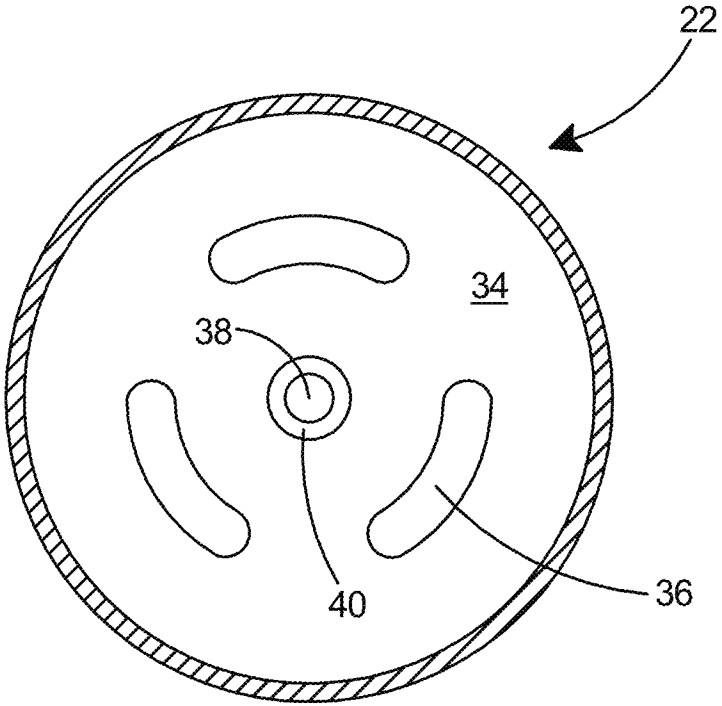
FIG. 9 is a sectional view taken along line 9-9 of FIG. 8.

Referring to FIGS. 9 and 10, a cell wall 34 extends between each cell 22. A plurality of coupling slots 36 are provided in each cell wall. The cell wall 34 preferably includes a center bore 38 and a cone 40 surrounding the center bore. As shown in FIG. 10, one or more cooling channels 42 are provided in each cell wall 34.

Figure 11:
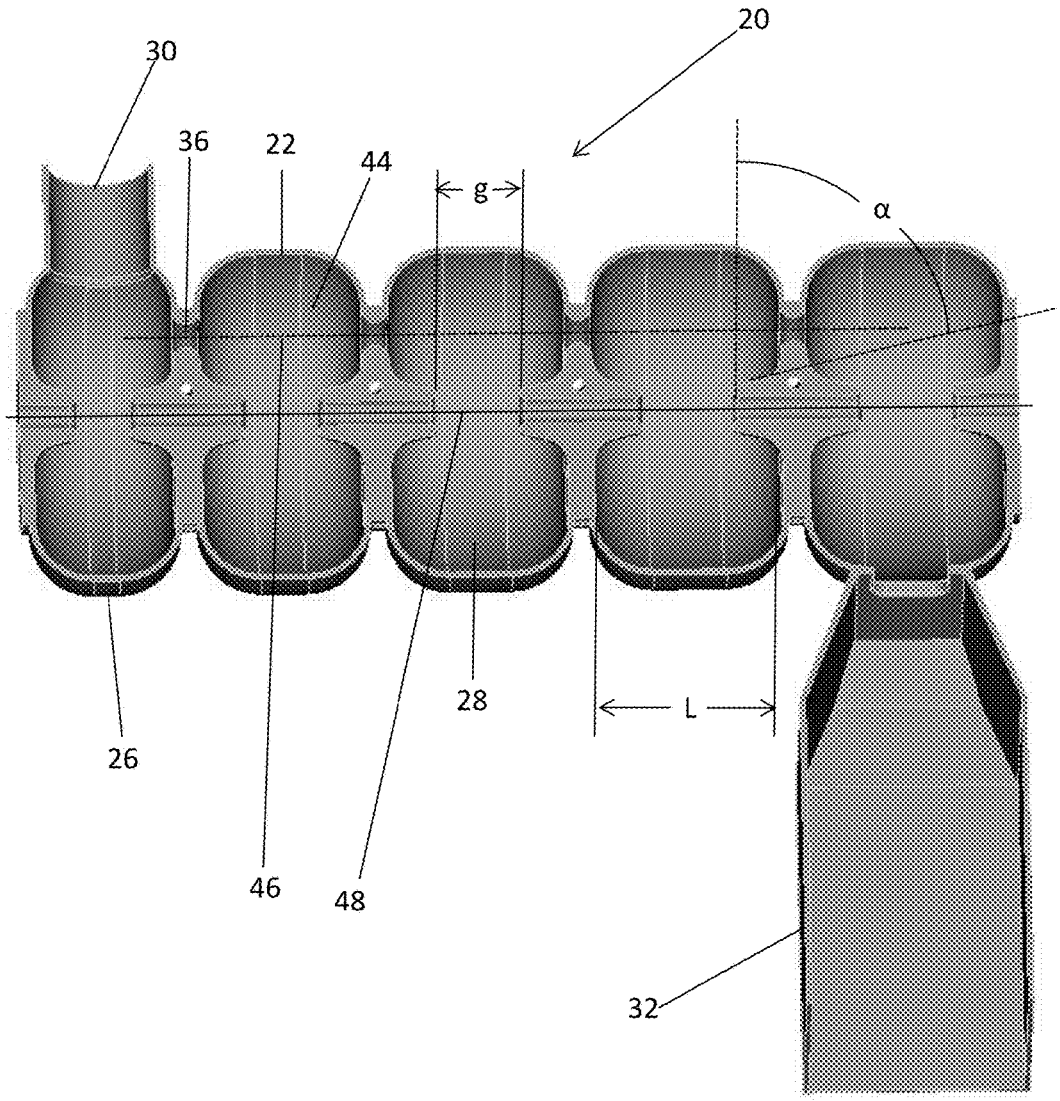
FIG. 11 is a sectional view taken longitudinally through the slot-coupled CW standing wave accelerating cavity of FIG. 8.
Figure 12A:
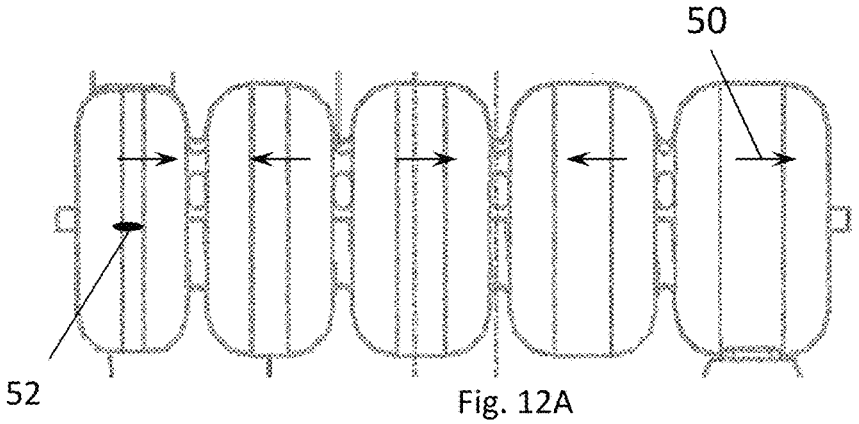
FIG. 12A-D show a schematic illustration of the relation between the particle motion and the field phase in cavities in a sequence of accelerator cells in a non-resonant slot-coupled CW standing wave accelerating cavity.
Figure 12B:
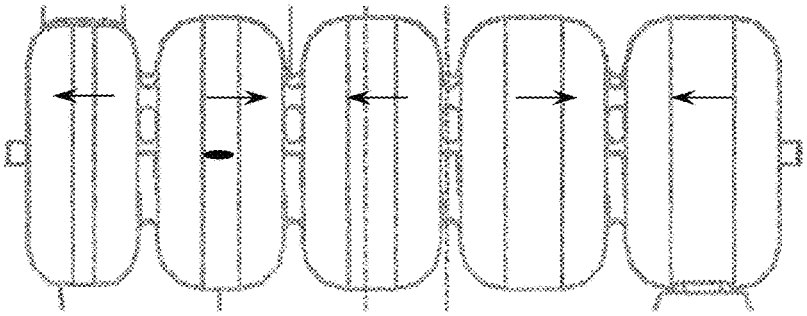
Figure 12C:
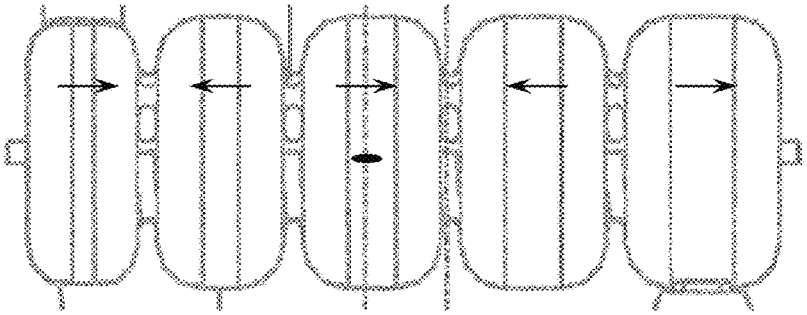
Figure 12D:
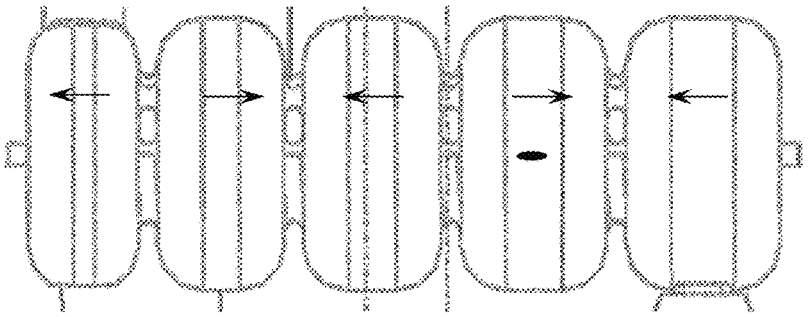

With reference to FIG. 11, slot-coupled CW standing wave accelerating cavity 20 includes a plurality of cell cavities 44. According to the present invention, the gap spacing g and cell length L are varied to accommodate varying beta, while the cone angle $\alpha$ is same for all cells for easier manufacturing and lowering the cost. In the preferred embodiment, the coupling slots 36 are in axial alignment such as along axis 46 of FIG. 11. Shorter slot lengths render the slots non-resonant. The accelerating cavity 20 includes a center bore 47 and a center axis 48 extending longitudinally through the center bore. The coupling slots 36 in the walls are in axial alignment with each other along axis 36 and are offset from the center axis 48 of the accelerating cavity.

FIG. 12A-D illustrate the electric field component 50 of the standing wave in a series of accelerator cells according to the invention, as it varies over time as a particle 52 passes through the cells. In a non-resonant slot-coupled CW standing wave accelerating cavity according to the invention, fields in all cells oscillate in pi-mode, the fields in neighboring cavities oscillate out of phase, and the particle always see the accelerating phase when it enters the next cavity because the cavity length is chosen for particle to take equal time of field phase flipping to travel through.

The bounding box of the CEBAF capture cavity at Jefferson National Accelerator Facility, Newport News, Virginia, has a transverse dimension of 14.3×30 $cm^2$. In a compact, efficient CW standing wave accelerating cavity with a slot-coupling arrangement according to the present invention, the bounding box has a transverse dimension of 13.4×13.4 $cm^2$. Much less power is required to achieve same acceleration results; 7 kW is needed for the slot-coupling design, versus approximately 10 kW in the traditional side-coupling design. The shunt impedance of the new slot-coupling design is 22 MOhm/m, as compared to larger than 18.8 MOhm/m in the side-coupling design.

As a comparison with conventional side-coupling design accelerators, the electron capture efficiency of Varian's 600C, available from Varian Medical Systems, Inc., Palo Alto, Calif., is 37%, while the slot-coupling design provides nearly 100% capture efficiency. After being scaled to 2998 MHz, the slot-coupling design has a shunt impedance of 151 MOhm/m, as compared with 115 MOhm in the Varian 600C.

As a further comparison, the cavities at LEP (Large Electron-Positron Collider at CERN in Geneva, Switzerland) and PEP (SLAC National Accelerator Laboratory at Stanford University, Palo Alto, Calif.) used two-slot coupling for pill-box shaped cells. They operate at about 352 MHz. After being scaled to 352 MHz, the slot-coupling design of the present invention with better cell shape has a higher shunt impedance of 31 MOhm/m, as compared with 26 MOhm/m (LEP) and 21 MOhm/m (PEP).

The compact and axis-symmetric nature of the new structure greatly simplifies embedding in a solenoid magnet for focusing or for transporting magnetized beams. In the present invention, the slots are non-resonant, thereby enabling shorter slot lengths and less power loss. The symmetry of the interior slots about the central axis of the cavities does not introduce any transverse (dipole) kicks, as compared to prior art multi-cell accelerator cavities having resonant slots. In cavities with resonant slots, transverse kicks are produced and must be averaged out by flipping the slot from one side to the other in alternate cells. The symmetry allows the propagation and extraction (damping) of all unwanted transverse higher-order modes (HOMs) that can cause beam break-up instabilities. This allows higher beam current to be operated stably. This is not possible with prior art one- or two-slot designs.

The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiments herein were chosen and described in order to best explain the principles of the invention and the practical application, and to enable others of ordinary skill in the art to understand the invention for various embodiments with various modifications as are suited to the particular use contemplated.

What is claimed is:

1. A slot-coupled continuous wave (CW) graded beta standing wave accelerating cavity, comprising:

a plurality of interconnected cells including a gap spacing, a cell length, a cone having a cone angle, a center bore, and a center axis extending longitudinally through the center bore;

a wall between each of said interconnected cells;

a plurality of non resonant coupling slots on the walls between said interconnected cells;

said coupling slots in said walls are in axial alignment with a corresponding slot in the plurality of interconnected cells and are offset to a common side from the center axis of the accelerating cavity;

the plurality of interconnected cells including a gap spacing and cell length that are varied throughout the length of the interconnected cells to accommodate varying beta and the cone angle is constant throughout the length of the interconnected cells;

the interconnected cells include a center symmetric axis and the slots in each wall are axisymmetric about the center axis; and each of said coupling slots extends no more than an angle of 60 degrees around the center symmetric axis.

2. The slot-coupled CW standing wave accelerating cavity of claim 1, further comprising an equator on each of said cells; and a cylindrical strip at each equator.

3. The slot-coupled CW standing wave accelerating cavity of claim 1, wherein said slots are kidney-shaped.

4. The slot-coupled CW standing wave accelerating cavity of claim 1, further comprising three or more of said slots on each of said walls.

5. The slot-coupled CW standing wave accelerating cavity of claim 2, wherein each of said cells in said plurality of interconnected cells is of a different length for graded beta acceleration.

6. The slot-coupled CW standing wave accelerating cavity of claim 5, wherein the width of the cylindrical strip is changed for different cells to vary the cell length.

7. The slot-coupled CW standing wave accelerating cavity of claim 1, wherein the plurality of cells include a gap spacing and a cell length;

the plurality of cells form a graded beta cavity; and the gap spacing and cell length are varied to accommodate varying beta and form a graded beta cavity.

8. The slot-coupled CW standing wave accelerating cavity of claim 7, wherein each of the interconnected cells in the plurality of cells include a cone angle; and the cone angle is same for all cells.

9. The slot-coupled CW standing wave accelerating cavity of claim 1, wherein each of said cells in said plurality of interconnected cells is of equal lengths for beta equal to 1 acceleration.

10. The slot-coupled CW standing wave accelerating cavity of claim 1, further comprising an internal cooling channel in each wall.

11. The slot-coupled CW standing wave accelerating cavity of claim 1, wherein the dimensions and geometry for the cell walls and slots are the same in each cell.

12. A method for high efficiency continuous wave (CW) graded beta acceleration, comprising:

a. providing a particle accelerator including a plurality of interconnected cells of varying length separated by walls there between, the interconnected cells including a center symmetric axis, a gap spacing, a cell length, and a cone having a cone angle;

b. providing a plurality of non resonant coupling slots on the walls between the interconnected cells to enable a pi-mode oscillating field;

c. axially aligning the coupling slots in the walls along an axis parallel with and offset to a common side from the center symmetric axis;

d. varying the gap spacing and cell length throughout the length of the interconnected cells to accommodate varying beta;

e. maintaining a constant cone angle throughout the interconnected cells; and f. limiting the extent of each of said coupling slots to no more than an angle of 60 degrees around the center symmetric axis.

13. The method of claim 12, further comprising providing a gap spacing between the interconnected cells; and varying the gap spacing between the cells accommodate varying beta and form a graded beta cavity.

14. The method of claim 12, further comprising providing an internal cooling channel in each wall.

15. The method of claim 12, further comprising providing a cone having a cone angle on each of said cells; and setting the cone angle the same for all cells.

* * * * *